US005492491A

United States Patent [19]

Yamamoto et al.

[11] Patent Number: 5,492,491

[45] Date of Patent: Feb. 20, 1996

[54] CRT ANODE CAP TERMINAL

[75] Inventors: Masahiro Yamamoto, Kanagawa; Sumio Maekawa, Souraku, both of Japan

[73] Assignee: Thomas & Betts Corporation, Memphis, Tenn.

[21] Appl. No.: 234,762

[22] Filed: Apr. 28, 1994

[51] Int. Cl.[6] ..... H01R 4/10

[52] U.S. Cl. ..... 439/877; 439/909; 439/855

[58] Field of Search ..... 439/834, 877, 439/909, 855; 439/834, 877, 909.1

[56] References Cited

U.S. PATENT DOCUMENTS

| | | | |
|---|---|---|---|
| 2,132,203 | 10/1938 | Clark | 173/269 |
| 2,784,386 | 3/1957 | MacFadden . | |
| 3,486,162 | 12/1969 | Leitmann . | |
| 4,155,614 | 5/1979 | Hall . | |
| 4,204,741 | 5/1980 | Hall . | |
| 4,382,650 | 5/1983 | Herrmann, Jr. . | |
| 4,422,707 | 12/1983 | Wada et al. . | |
| 4,801,276 | 1/1989 | Thole | 439/909.1 |
| 4,894,023 | 1/1990 | Hall | 439/278 |
| 5,096,445 | 3/1992 | Lostumo | 439/865 |

*Primary Examiner*—David L. Pirlot
*Assistant Examiner*—Jill DeMello
*Attorney, Agent, or Firm*—Robert M. Rodrick

[57] ABSTRACT

A cable pinching section and a core wire connecting section are integrally linked together to allow connection of a cable before a terminal main body is assembled, thus simplifying a cable connection. In addition, terminal portions are formed as box-shaped terminals to obtain a reliable and stable engagement with a CRT anode electrode.

6 Claims, 2 Drawing Sheets

CRT ANODE CAP TERMINAL

FIELD OF THE INVENTION

The present invention relates to an anode cap terminal to be electrically and mechanically connected to, for example, the anode of a Braun tube (CRT) of a television receiver.

BACKGROUND OF THE INVENTION

An anode cap of the type set forth herein generally comprises, an anode engaging terminal comprising a coil spring or a pair of opposing leaf springs, a cable connecting member for pinching a high-voltage cable and connecting with the core wire of the cable (by soldering in many cases), and an insulating cover for covering these members. After the terminal main body of the anode cap is formed, the high-voltage cable is connected to the cable connecting member of the terminal main body.

This conventional anode cap, however, is not stably engaged with an anode (which forms a recessed fitting portion) and is not readily removed from an anode once engaged. In addition, connecting a cable with this anode cap is a cumbersome manipulation.

SUMMARY OF THE INVENTION

In an effort to solve the above problems, a CRT anode cap terminal of the present invention has an arrangement in which a pair of generally T-shaped terminal plates opposing each other are formed on each of a pair of terminal portions to be locked into the anode of a CRT. A cable pinching section is provided for pinching the insulator of a cable and a core wire connecting section for connecting with the core wire of the cable, which are linked into a bridge-like shape relative to the terminal portions.

Before the terminal main body of the terminal of the present device is assembled, the cable pinching section and the core wire connecting section linked together are connected with the insulator and the core wire of a cable, respectively. After the terminal is assembled, a rubber cap is placed on the terminal, and the pair of terminal plates formed on each terminal portion are locked into the anode of a CRT.

One embodiment of the present device will be described below with reference to the accompanying drawings.

DETAILED DESCRIPTION OF THE PREFERRED EMBODIMENTS

Figure 1:
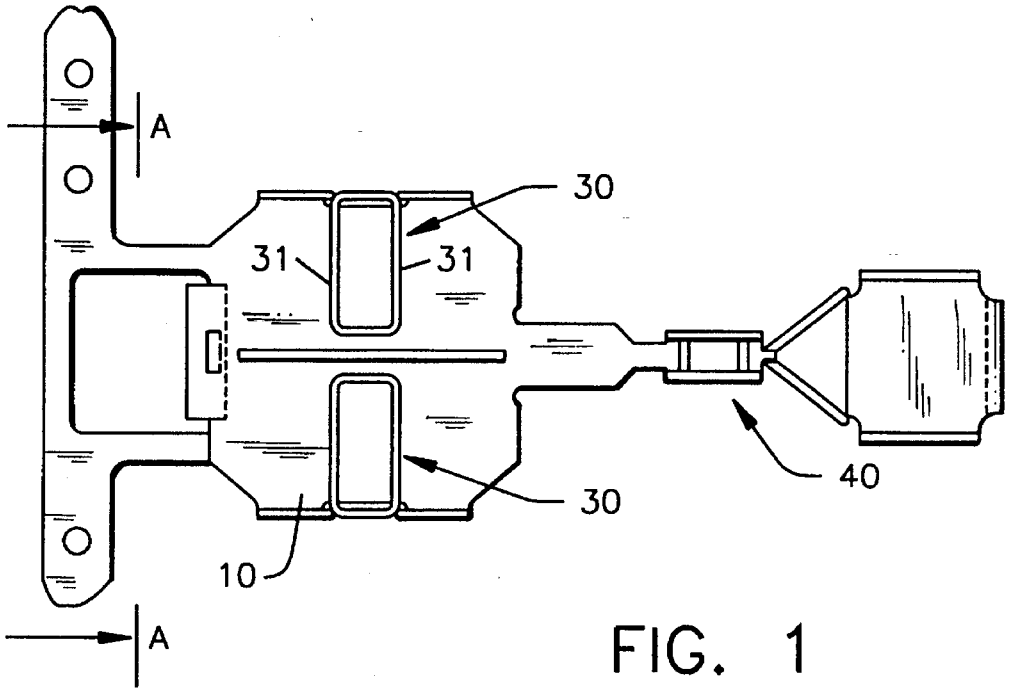
FIG. 1 is a developed top plan view showing a CRT anode cap terminal according to the present invention.
Figure 2:
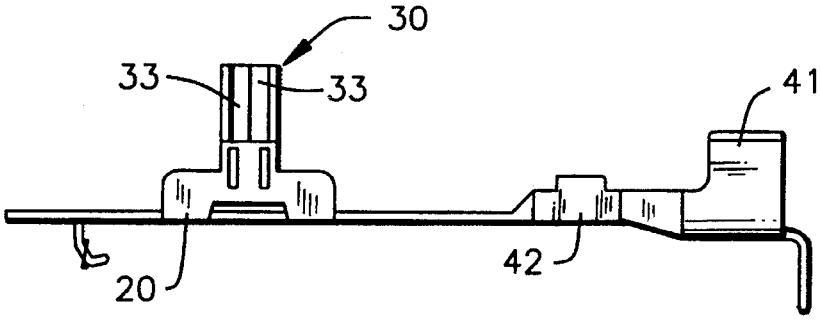
FIG. 2 is a developed side view showing the terminal illustrated in FIG. 1.
Figure 3:
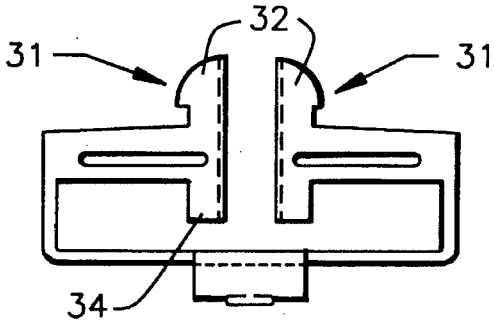
FIG. 3 is a sectional view taken along the viewing line A—A of the terminal illustrated in FIG. 1.
Figure 4:
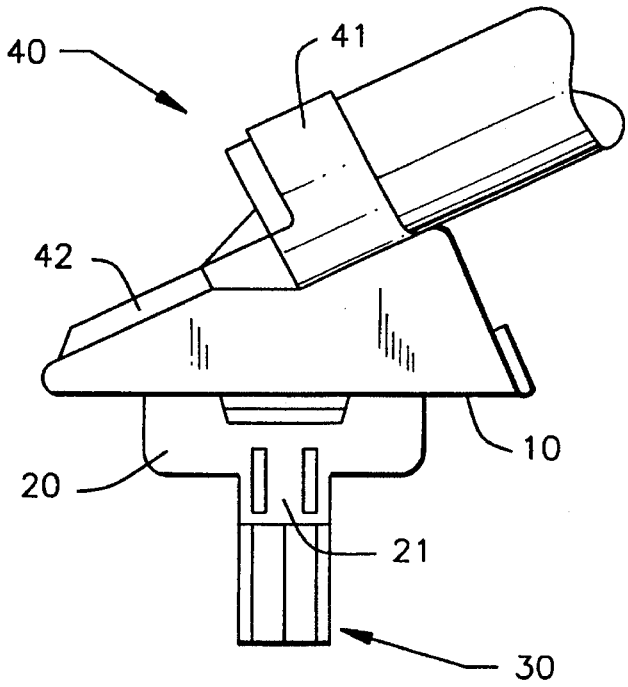
FIG. 4 is a side view showing the CRT anode cap terminal according to the present invention after it is assembled.
Figure 5:
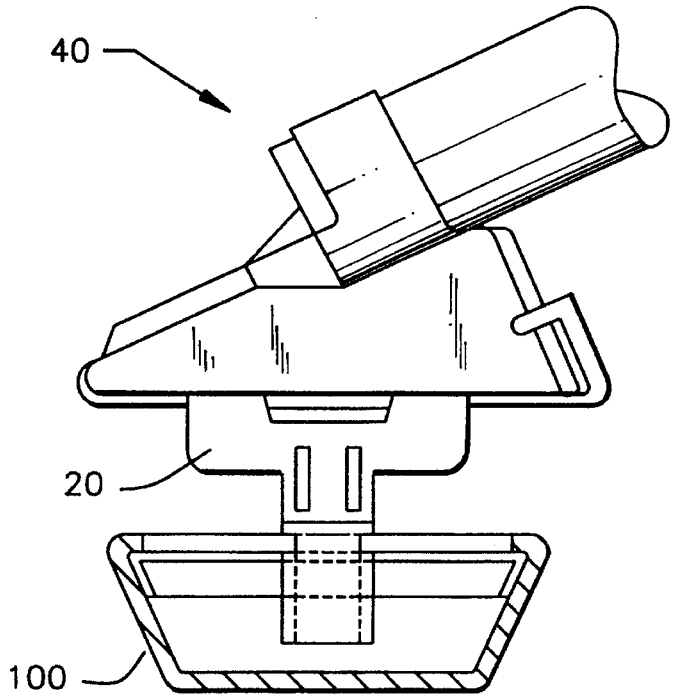
FIG. 5 is a side view showing in use the CRT anode cap terminal according to the present invention.

FIGS. 1 and 2 show a terminal main body according to the present invention before it is assembled. Although a plurality of these terminal main bodies are coupled to a carrier, one terminal main body is illustrated in FIGS. 1 and 2. When in use, each terminal main body is disconnected from the carrier. As shown in FIG. 3 and the subsequent figures, a cable connecting member (to be described later) of each disconnected terminal main body is bent into a bridge-like shape to lock the two ends of the terminal main body together.

As shown in these drawing figures, the terminal main body comprises a shielding base plate 10, a pair of terminal portions 30, a pair of supporting plates 20 extending from the shielding base plate to support the terminal portions, and a cable connecting member 40. Each of the two supporting plates 20 extends downward from one side of the shielding base plate 10 such that the two supporting plates 20 oppose each other. Each terminal portion 30 projects from one supporting plate 20 toward the opposite supporting plate. The cable connecting member 40 is formed on the opposite side of the shielding base plate.

Each terminal portion 30 has a pair of generally T-shaped terminal plates 31 opposing each other. Each of these terminal plates has a latching section 32 projecting in a direction opposite to the shielding baseplate. The latching section 32 is shaped into an arrowhead so as to be locked into the anode of a CRT. The cable connecting member 40 comprises a cable pinching section 41 for pinching the insulator of a cable, and a core wire connecting section 42 which is linked to the cable connecting member and connects with the core wire of a cable. The cable connecting member 40 with this arrangement is formed as a bridge between the two opposing sides of the shielding base plate.

In the embodiment shown in these drawing figures, each of the terminal portions 30 is formed as a box-shaped terminal having a generally square cross section. Each terminal portion includes a terminal base plate extending downward from the corresponding supporting plate 20, the above-mentioned T-shaped terminal plates 31 projecting from the two sides of the terminal base plate, and a pair of half-side plates 31 projecting from the two sides of the terminal base plate, and a pair of half-side plates 33 each projecting from one side of the terminal plate facing the opposite terminal portion in a direction toward the opposite terminal plate.

The terminal portions 30 projecting from the supporting plates are so arranged as to oppose each other with a certain gap between them. Consequently, the pair of terminal portions 30 are flexible, i.e., they can move close to or away from each other while being supported by their respective supporting plates.

When in use, two terminal portions are forced to move close to each other by pinching the pair of supporting plates with fingers and then inserted into the anode electrode of a CRT. To remove the terminal portions from the anode electrode, the two supporting plates need only be pinched with fingers in the same fashion as in the insertion.

Note that the generally T-shaped terminal plates 31 have stopper plates 34 (FIG. 3) projecting from the opposite side to the latching sections 32. Therefore, these terminal portions are not bent to a larger extent than is necessary.

The cable connecting member 40 described hereinbefore extends from one of the opposing sides of the shielding base plate, and the end portion of the cable connecting member 40 connects with the other side of the shielding base plate. Formation of the terminal cap for use is achieved by inserting the end portion of the connecting member into a slit formed in the shielding base plate and bending the end portion inserted through the slit.

The terminal portions of the CRT anode cap terminal according to the present device are thus formed into box-shaped terminals. Therefore, these terminal portions have no degree of freedom when attached to a CRT anode electrode (a recessed fitting portion), as compared with plate-shaped terminal portions. Consequently, the terminal portions accurately oppose the anode electrode and are locked into the anode electrode highly stably and reliably.

In the cable connecting member of the terminal of the present device, the cable pinching section and the core wire connecting section are integrally linked together. Therefore, there is no change in the positional relationship (the distance) between these sections before and after the assembly of the terminal main body, unlike in a terminal in which a cable pinching section and a core wire connecting section are separately formed apart from each other. This makes it possible to connect the insulator and the core wire of a cable with the cable pinching section and the core wire connecting section, respectively, before the terminal main body is assembled. In addition, the manipulation of connecting a cable with the terminal is simplified because the present device requires no soldering.

Note that since the distance between the cable pinching section and the core wire connecting section is fixed, the positional relationship between the two sections when a cable is connected is also fixed. Therefore, no variations are produced between the two sections unlike in conventional terminals in which these two sections are formed separately. This precludes a cumbersome manipulation of, for example, increasing or decreasing the length of the core wire in order to compensate for variations.

Furthermore, the stopper plates project from the generally T-shaped terminal plates of each terminal portion. Consequently, when the terminal plates are pinched to bend inward in locking the terminal of the present device into a anode electrode, these terminal plates are not bent to a larger degree than is needed because of the function of the stopper plates.

As is apparent from the embodiment shown in the accompanying drawing figures, the shielding base plate of the anode cap terminal of the present device can cover the entire anode electrode of a CRT, resulting in a large X-ray attenuating effect. In addition, as compared with a conventional terminal whose cable pinching section extends outward from a terminal main body, the cable connecting member of the present device does not project into an insulating cover which covers the terminal but is entirely housed in the insulating cover without being forced. This ensures a sufficient insulating distance.

The preferred embodiment of the invention having been described herein, it should be appreciated that variations may be made thereto without departing from the contemplated scope of the invention. Therefore, the preferred embodiments are considered illustrative and not limiting. The true scope of the invention is set forth in the claims appended hereto.

We claim:

1. A CRT anode cap terminal, comprising:

a shielding base plate (10), a pair of supporting plates (20, 20) being generally opposite each other, each plate extending from one side of said shielding base plate;

terminal portions (30, 30), one each extending from a one of said supporting plates; and a cable connecting member (40) at a side opposite said shielding base plate;

each of said terminal portions comprising a box-shaped terminal (30) and a latching section (32) extending in a direction upwardly from said shielding base plate;

said cable connecting member (40) comprising a cable pinching section (41) for pinching insulation of a cable and a connecting section (42) linked to said cable pinching section for connecting with a core wire of the cable, said cable connecting member being formed as a bridge between two spaced, opposing sides of said shielding base plate.

2. A CRT anode cap terminal according to claim 1, wherein said terminal portions are flexible and opposite thereby interposing a gap therebetween.

3. A CRT anode cap terminal according to claim 1, wherein said cable connecting member (40) extends from one side of said shielding base plate and connects with the other side of said shielding base plate.

4. A CRT anode cap terminal according to claim 1, wherein each of said box-shaped terminals has a generally rectangular cross section, each said terminal portion comprising a terminal base plate (21) extending upward from said supporting plate and a pair of generally T-shaped terminal plates (31, 31) each pair extending opposite each other, and a pair of half side plates (33, 33) each extending from one side of a respective terminal plate in a direction toward the opposite terminal plate.

5. A CRT anode cap terminal according to claim 4, wherein each of said T-shaped terminal plates (31, 31) has a stopper plate (34) extending at a side opposite to said latching section (32).

6. A CRT anode cap terminal, comprising:

a shielding base plate (10), a pair of supporting plates (20, 20) being generally opposite each other, each plate extending from one side of said shielding base plate;

terminal portions (30, 30), one each extending from one of said supporting plates; and a cable connecting member (40) at a side opposite said shielding base plate;

each of said terminal portions comprising a terminal plate (31) and a latching section (32) extending in a direction upwardly from said shielding base plate, each terminal plate (31) including a stopper plate (34) extending at a side opposite to said latching section (32);

said cable connecting member (40) comprising a cable pinching section (41) for pinching insulation of a cable and a connecting section (42) linked to said cable pinching section for connecting with a core wire of the cable, said cable connecting member being formed as a bridge between two spaced, opposing sides of said shielding base plate.

* * * * *